US007909982B2

(12) United States Patent
Glass et al.

(10) Patent No.: US 7,909,982 B2
(45) Date of Patent: Mar. 22, 2011

(54) TREATMENT PROCESS FOR CONCRETE

(76) Inventors: Gareth Glass, Staffordshire (GB); Adrian Roberts, Nottinghamshire (GB); Nigel Davison, Derbyshire (GB)

( * ) Notice: Subject to any disclaimer, the term of this patent is extended or adjusted under 35 U.S.C. 154(b) by 661 days.

(21) Appl. No.: 11/908,858

(22) PCT Filed: Mar. 14, 2006

(86) PCT No.: PCT/GB2006/050054
§ 371 (c)(1),
(2), (4) Date: Sep. 17, 2007

(87) PCT Pub. No.: WO2006/097770
PCT Pub. Date: Sep. 21, 2006

(65) Prior Publication Data

US 2009/0229993 A1 Sep. 17, 2009

(30) Foreign Application Priority Data

Mar. 16, 2005 (GB) ..... 0505353.3
Oct. 4, 2005 (GB) ..... 0520112.4
Jan. 13, 2006 (GB) ..... 0600661.3

(51) Int. Cl.
*C23F 13/16* (2006.01)
*C23F 13/02* (2006.01)
*C23F 13/04* (2006.01)
*C23F 13/10* (2006.01)
*C23F 13/12* (2006.01)
*C23F 13/14* (2006.01)
*C23F 13/20* (2006.01)
*C23F 13/22* (2006.01)

(52) U.S. Cl. ..... 205/734; 205/724; 205/725; 205/726; 205/727; 205/730; 205/731; 205/732; 205/733; 204/196.02; 204/196.04; 204/196.06; 204/196.07; 204/196.1; 204/196.17; 204/196.18; 204/196.22; 204/196.23; 204/196.25; 204/196.3; 204/196.36; 204/196.37

(58) Field of Classification Search ..... 204/196.02, 204/196.04, 196.06, 196.07, 196.1, 196.17, 204/196.18, 196.22, 196.23, 196.24, 196.25, 204/196.3, 196.36, 196.37; 205/724, 725, 726, 727, 730, 731, 732, 733, 734
See application file for complete search history.

(56) References Cited

U.S. PATENT DOCUMENTS 5,139,634 A 8/1992 Carperter et al.

(Continued)

FOREIGN PATENT DOCUMENTS

EP 0186334 A1 7/1986

(Continued)

OTHER PUBLICATIONS

Glass, Developments In Cathodic Protection Applied to Reinforced Concrete, Sep./Oct. 2001, Journal of Materials in Civil Engineering, vol. 13, No. 5, pp. 396-398.

(Continued)

*Primary Examiner* — Bruce F Bell
(74) *Attorney, Agent, or Firm* — Davis & Bujold, P.L.L.C.

(57) ABSTRACT

A single anode system used in multiple electrochemical treatments to control steel corrosion in concrete comprises a sacrificial metal that is capable of supporting high impressed anode current densities with an impressed current anode connection detail and a porous embedding material containing an electrolyte. Initially current is driven from the sacrificial metal [1] to the steel [10] using a power source [5] converting oxygen and water [14] into hydroxyl ions [15] on the steel and drawing chloride ions [16] into the porous material [2] around the anode such that corroding sites are moved from the steel to the anode restoring steel passivity and activating the anode. Cathodic prevention is then applied. This is preferably sacrificial cathodic prevention that is applied by disconnecting the power source and connecting the activated sacrificial anode directly to the steel.

44 Claims, 4 Drawing Sheets

U.S. PATENT DOCUMENTS

| | | | | |
|---|---|---|---|---|
| 5,292,411 | A | 3/1994 | Bartholomew et al. | |
| 5,421,968 | A | 6/1995 | Bennett et al. | |
| 5,538,619 | A | 7/1996 | Miller | |
| 5,650,060 | A | 7/1997 | Huang et al. | |
| 5,714,045 | A | 2/1998 | Alltrista | |
| 5,968,339 | A | 10/1999 | Clear | |
| 6,027,633 | A | 2/2000 | Whitmore | |
| 6,217,742 | B1 | 4/2001 | Bennett | |
| 6,238,545 | B1 | 5/2001 | Allebach et al. | |
| 6,258,236 | B1 | 7/2001 | Hird | |
| 6,322,691 | B1 | 11/2001 | Miller | |
| 6,332,971 | B1 | 12/2001 | Hill | |
| 6,346,188 | B1 | 2/2002 | Shuster et al. | |
| 6,419,816 | B1 * | 7/2002 | Lyublinski | 205/734 |
| 2004/0011669 | A1 * | 1/2004 | Glass et al. | 205/766 |
| 2004/0186221 | A1 | 9/2004 | Pitchumani et al. | |
| 2006/0108235 | A1 * | 5/2006 | Whitmore et al. | 205/724 |
| 2007/0158184 | A1 * | 7/2007 | Benham | 204/196.06 |
| 2008/0047843 | A1 * | 2/2008 | Glass et al. | 205/730 |
| 2008/0105564 | A1 * | 5/2008 | Glass et al. | 205/734 |
| 2009/0032410 | A1 * | 2/2009 | Glass et al. | 205/724 |
| 2010/0147703 | A1 * | 6/2010 | Glass et al. | 205/732 |

FOREIGN PATENT DOCUMENTS

| | | | |
|---|---|---|---|
| EP | 0499437 | A1 | 8/1992 |
| GB | 2309978 | A | 8/1997 |
| GB | 2389591 | A | 12/2003 |
| JP | 60029478 | A | 2/1985 |
| JP | 4116184 | A | 4/1992 |
| JP | 9031675 | A | 2/1997 |
| WO | 9429496 | A1 | 12/1994 |
| WO | 9816670 | A1 | 4/1998 |
| WO | 0233148 | A1 | 4/2002 |
| WO | 2005106076 | A2 | 11/2005 |

OTHER PUBLICATIONS

Glass et al, Cathodic Protection Afforded by an Intermittent Current Applied to Reinforced Concrete, 2001, Corrosion Science, vol. 43, issue 6, pp. 1111-1131.

Glass et al, Criteria for Novel Electrochemical Treatments of Steel in Concrete, Oct. 13-15, 2003, Conference Proceedings, 7th International Conference: Concrete in Hot & Aggressive Environments, Kingdom of Bahrain, pp. 477-491.

Glass et al, Achieving High Chloride Threshold Levels on Steel in Concrete, 2004, Corrosion 2004, Paper No. 04332, pp. 1-17.

Glass et al, Surprisingly Effective Cathodic Protection, 2003, The Journal of Corrosion Science and Engineering, vol. 4, Paper 7, pp. 1-14.

Glass et al, Short Communication: On The Current Density Required to Protect Steel In Atmospherically Exposed Concrete Structures, 1995, Corrosion Science, vol. 37, No. 10, pp. 1643-1646.

British Standards Institution, Cathodic Protection of Steel In Concrete, Mar. 2000, BS EN 12696:2000, pp. 1-40.

European Committee for Standardization, Technical Specification: Electrochemical Realkalization and Chloride Extraction Treatments For Reinforced Concrete, May 2004, ed. Mietz, prCEN/TS 14038-1.

Institute of Materials, Electrochemical Rehabilitation Methods For Reinforced Concrete Structures: A State of the Art Report, 1998, European Federation of Corrosion Publications, ed. Mietz, No. 24, pp. 1-3.

http://www.npl.co.uk/ncs/docs/cathodic_protection.pdf, Cathodic Protection, retrieved Dec. 24, 2004, eds. Kean and Davies, sections 5.0, 6.3 and 6.4.

http://www.anodia.gr/technical2.php, US Navy Specification MIL-A-24779 (SH), retrieved Jan. 11, 2008.

* cited by examiner

TREATMENT PROCESS FOR CONCRETE

TECHNICAL FIELD

This invention relates to the electrochemical treatment of reinforced concrete to protect it from deterioration arising from corrosion of the steel. More specifically, this invention is concerned with a hybrid electrochemical treatment to arrest steel reinforcement corrosion and subsequently prevent corrosion initiation.

BACKGROUND ART

Corrosion of steel in reinforced concrete is a major problem. Both sustained and temporary electrochemical treatments have been used to arrest this problem. These involve passing a current through the concrete to the steel from an installed anode system. In all cases the steel becomes the cathode of the electrochemical cell that is formed. In impressed current electrochemical treatment, the anode is connected to the positive terminal and the steel is connected to the negative terminal of a source of DC power. In sacrificial electrochemical treatment, the protection current is provided by corroding sacrificial anodes that are directly connected to the steel.

Sustained or long term electrochemical treatments are installed with the intention of maintaining the treatment for the foreseeable future. The electrochemical treatment period would typically be measured in years. A well known family of sustained or long term techniques is cathodic protection. It includes impressed current cathodic protection, sacrificial cathodic protection, intermittent cathodic protection and cathodic prevention. In these techniques a long term or permanent anode delivers a small current to the steel reinforcement. Average current densities expressed per unit area of steel surface typically range from 2 to 20 $mA/m^2$ to arrest existing deterioration and 0.2 to 2 $mA/m^2$ to prevent the initiation of deterioration. The current may be pulsed but the average applied currents are typically within the above ranges. The current may from time to time be adjusted with adjustments based on an analysis of performance data.

Temporary or short term electrochemical treatments are installed with the intention of discontinuing the treatment in the foreseeable future. The electrochemical treatment period would typically be measured in days, weeks or months. Temporary treatments designed to arrest reinforcement corrosion include chloride extraction (U.S. Pat. No. 6,027,633) and re-alkalisation (U.S. Pat. No. 6,258,236). In these systems a temporarily installed anode system is used in conjunction with a temporary DC power supply to deliver a large current of the order of 1000 $mA/m^2$ expressed per unit area of steel surface for a short period (typically less than 3 months) to the steel reinforcement.

Anodes are electrodes supporting a net oxidation process. Anodes for concrete structures may be divided into inert anodes or sacrificial anodes. They may be further divided into anodes that are embedded within a porous matrix or anodes that are attached to the concrete surface such that they are exposed and accessible, as well as into discrete or non-discrete anodes. Anode systems that include an anode and a supporting electrolyte may be divided into temporary and long term anode systems. A summary of the differences is given in the following paragraphs.

Inert anodes resist anode consumption. They have been used in most electrochemical treatments, the principle exception being sacrificial cathodic protection. The main anodic reaction is the oxidation of water producing oxygen gas and acid. The acid attacks the cement paste in concrete. As a result, the current density off inert anodes tends to be limited to less than 200 $mA/m^2$ expressed per unit area of anode surface. A widely used anode system is a mixed metal oxide (MMO) coated titanium mesh embedded in a cementitious overlay on the concrete surface (U.S. Pat. No. 5,421,968). A discrete porous titanium oxide anode that is claimed to deliver higher anode current densities up to 1000 $mA/m^2$ off the anode surface has also been used (U.S. Pat. No. 6,332,971).

Sacrificial anodes are consumed in the process of delivering the protection current. The main anodic reaction is the dissolution of the sacrificial metal. As a result the life of sacrificial anodes is limited. Sacrificial anodes have been applied as embedded (buried) discrete anodes in sacrificial cathodic prevention systems (WO 9429496) and as a mesh with an overlay in sacrificial cathodic protection (U.S. Pat. No. 5,714,045). However the use of embedded sacrificial anode systems is deterred by the need to replace the anodes at the end of their life. Sacrificial anodes systems have also been attached directly to the concrete surface (U.S. Pat. No. 5,650,060) and are accessible to facilitate anode replacement. The use of sacrificial anodes in an impressed current role is deterred by the more rapid consumption of the anode in this role. However surface applied anodes are easy to replace and this type of system has been used as an impressed current anode at anode current densities typically less than 25 $mA/m^2$ (U.S. Pat. No. 5,292,411).

Discrete anodes are individually distinct compact anodes that are normally embedded in holes in the concrete or installed at locations where patch repairs to the concrete are undertaken. A description of discrete anodes is given in U.S. Pat. No. 6,217,742. Embedded discrete anodes are strongly attached to the concrete and attachment failures are less common for discrete anodes than for the non-discrete anodes applied to concrete surfaces.

Temporary anode systems are usually attached to the concrete surface to deliver short term high current temporary electrochemical treatments and are removed at the end of the treatment period that is typically less than 3 months. Temporary anodes are surrounded by a temporary electrolyte, such as a liquid contained in a tank or an electrolytic material such as saturated cellulose fibre, that is easily removed at the end of the treatment process (U.S. Pat. No. 5,538,619). A high drive voltage together with a high volume of electrolyte is generally needed to support the high current output. By contrast, long term anode systems, intended to deliver a protection current over several years, are strongly attached to the concrete and may be embedded in cavities in the concrete to improve anode attachment.

DISCLOSURE OF INVENTION

Technical Problem

Impressed current cathodic protection is the most proven of the existing methods of arresting chloride induced corrosion of steel in concrete. However it requires a high level of maintenance when compared with other inspection or maintenance requirements of reinforced concrete structures. In addition, impressed current cathodic protection systems are generally commissioned after all the delaminated and spalled concrete areas have been repaired and then only at protection current densities significantly below local steel corrosion rates as high start up cathodic protection currents have deleterious effects resulting from the generation of acid and gas on some anode systems. While low current densities eventually arrest corrosion, corrosion induced damage continues to occur until the corrosion process is arrested.

Temporary electrochemical treatments rapidly arrest the corrosion process and have no maintenance requirements after the initial treatment. However a substantial level of chloride sometimes remains and there are concerns regarding the durability of such treatments in chloride containing environments. Furthermore, the duration of the treatment may last several months and access to the treated surface is restricted during this time.

Sacrificial cathodic protection is not always considered to be powerful enough to arrest corrosion. However it is a low maintenance, reliable process that can be used in a preventative role.

The problem solved by this invention is the efficient delivery of powerful electrochemical protection treatments to corroding steel in concrete to arrest corrosion and to achieve long term durability of the protective effects with minimal maintenance requirements and minimal disruption during system installation.

Technical Solution

An analysis of available data provides strong evidence that electrochemical treatments applied to reinforced concrete arrest corrosion by restoring the alkalinity at corroding sites using a relatively small amount of charge. Existing electrochemical treatments may therefore be improved by splitting the treatment into two phases; namely, a brief initial high current treatment to rapidly arrest corrosion minimising further damage, and a subsequent long term preventative treatment with low maintenance requirements to sustain passivity and ensure durability. A single multiple treatment anode that is capable of delivering both the initial high current, short term electrochemical treatment to arrest corrosion and subsequently the long term, low current treatment to prevent subsequent corrosion initiation is disclosed. To deliver the initial high current treatment, the multiple treatment anode is capable of delivering very high current densities off the anode surface at low safe DC voltages. To achieve a durable long term preventative treatment the multiple treatment anode is used in a cathodic prevention role, preferably connected to the steel as a sacrificial anode.

The multiple treatment anode is based on the use of a sacrificial anode metal in a temporary high impressed current role. One observation leading to the development of the multiple treatment anode was that an aluminium alloy sacrificial anode metal can deliver current densities in excess of 10 000 $mA/m^2$ (expressed per unit of anode area) off the anode surface at very low safe DC voltages that are not sufficiently positive to induce gas evolution even when the sacrificial anode is embedded in a porous material in a cavity formed in reinforced concrete. This is possible because the anodic reactions occur easily on sacrificial anode metals when compared with the anodic reactions occurring on inert impressed current anodes. Very high current density compact discrete anodes may therefore be embedded in the concrete to limit the disruption caused during the brief high impressed current treatment. A brief high impressed current treatment moves corroding sites from locations on the reinforcing steel to installed sacrificial anodes because hydroxide is produced at the steel causing the pH to rise and aggressive ions like chloride and sulphate are drawn from the concrete to the sacrificial anode. The anode may be subsequently used as an activated sacrificial anode to maintain steel passivity.

Accordingly, the present invention provides in a first aspect, a method of protecting steel in concrete that comprises using an anode and a source of DC power and a temporary impressed current treatment and a low current preventative treatment wherein the temporary impressed current treatment is a high current treatment using the source of DC power to drive current off the anode to the steel to improve the environment at the steel and the low current preventative treatment is applied to inhibit steel corrosion initiation after the application of the temporary impressed current treatment and the same anode is used in both treatments and the anode comprises a sacrificial metal element that undergoes sacrificial metal dissolution as its main anodic reaction.

Another observation leading to the development of multiple treatment technology was the high charge density of aluminium alloy anodes. Four aluminium alloy anodes 100 mm long and 15 mm in diameter have sufficient charge to deliver approximately 500 mA for one week and 1 mA for 50 years in their impressed current and sacrificial anode functions. The high charge density of some sacrificial anodes means that long lives are achievable from small sacrificial anodes embedded in concrete. This alleviates the concerns regarding the costs of replacing the anodes embedded in porous materials at the end of their service lives.

The inclusion of an impressed current anode connection detail on a compact discrete sacrificial anode alleviates the risk of corroding the connection when the discrete sacrificial anode is used as an impressed current anode. Forming the sacrificial anode metal around an impressed current anode that may be used in an impressed current cathodic prevention role after the sacrificial metal has been consumed may also be used to extend the life of the treatment.

ADVANTAGEOUS EFFECTS

The anodic reactions occurring on a sacrificial metal occur more easily than the anodic reactions occurring on an inert anode and require less driving voltage and generate less acid and less gas. This enables a brief high current electrochemical treatment to be delivered more easily. The application of a high current to a steel cathode of an electrochemical cell rapidly arrests corrosion of the steel minimising further corrosion damage. Aggressive ions in the concrete are drawn to the anode by the impressed current treatment. The combination of these aggressive ions and the sacrificial metal forms a sacrificial anode that is activated without the addition of other activating chemicals to the concrete. Connecting this sacrificial anode directly to the steel provides a simple method of applying a continuous, preventative treatment to inhibit future corrosion initiation. The corroding areas are effectively moved from the steel to the installed anode during the initial treatment. Embedding an anode system within the concrete allows the concrete surface to be used while the high impressed current electrochemical treatment is applied.

DESCRIPTION OF DRAWINGS

The invention is now further described with reference by way of example to the drawings in which.

MODE FOR INVENTION

Mechanism of Electrochemical Protection

Figure 1:
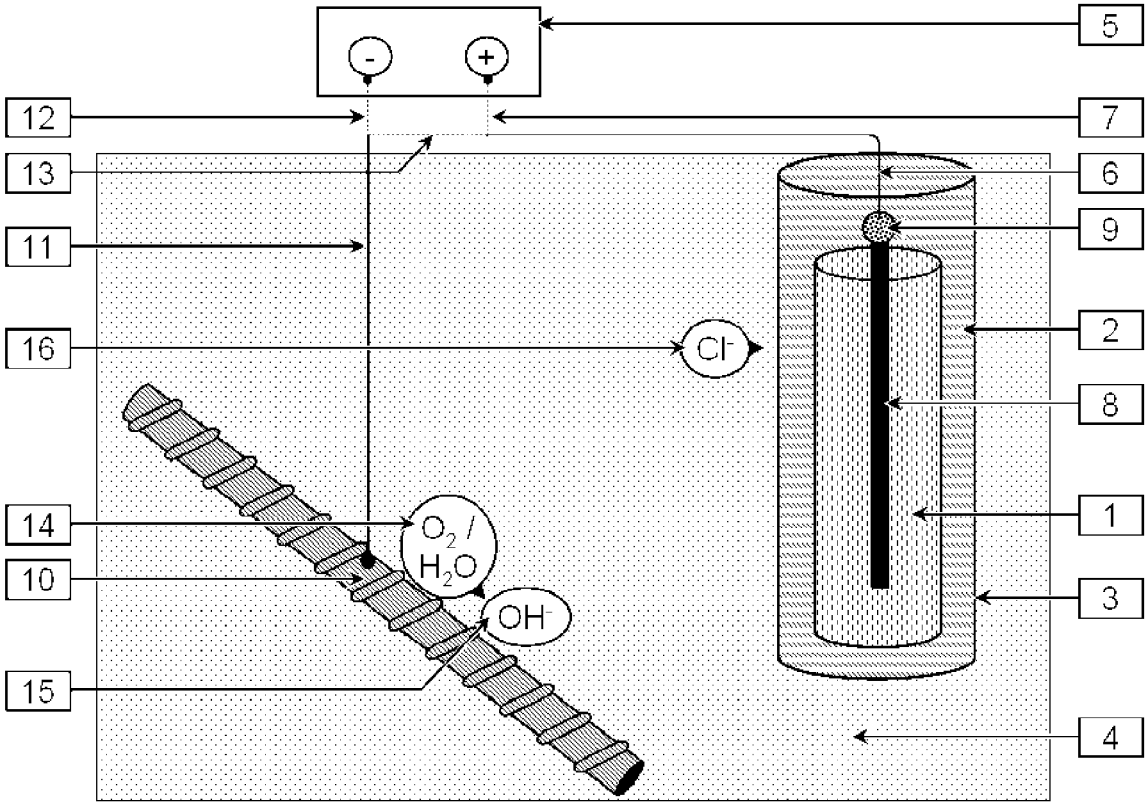
FIG. 1 shows a schematic diagram of the use of an anode in a hybrid impressed current-sacrificial electrochemical treatment.

Electrochemical treatments applied to steel in concrete include cathodic protection and prevention, intermittent cathodic protection, chloride extraction and re-alkalisation. The protective effects induced by these treatments are a negative driven potential shift that inhibits the dissolution of steel to form positive iron ions (corrosion), the removal of chloride ions from the steel surface that renders the environment less aggressive to passive films on steel, and the generation of hydroxyl ions at the steel surface that stabilises the formation of passive films on steel. The traditional understanding of reinforced concrete electrochemical treatments is that different treatments rely on different protective effects. In this understanding, the basis for cathodic protection is the achievement of a negative driven potential shift. Re-alkalisation of carbonated concrete requires the generation of a reservoir of hydroxide around the steel. Chloride extraction requires the removal of chloride ions from the concrete. Intermittent cathodic protection relies on changing the environment at the steel either by removing chloride or by generating hydroxyl ions to inhibit steel corrosion for a short period while the protection current is interrupted.

It has been argued that the protective effects of a negative potential shift are negligible and most electrochemical treatments used to arrest ongoing corrosion of steel in concrete achieve this by inducing open circuit steel passivity by extracting chloride and generating hydroxyl ions at the steel. While this observation is still disputed in the case of cathodic protection (see discussion and reply in Journal of Materials in Civil Engineering, 13(5) 396-398, 2001), the collation and analysis of the available evidence below suggests that one protective effect is likely to have a dominant effect on the success of all electrochemical treatments applied to steel in atmospherically exposed concrete. This dominant protective effect is the increase in pH at the steel/concrete interface.

Atmospherically exposed concrete is concrete that is periodically allowed to dry out such that the cathodic reaction kinetics (the reduction of oxygen) on the steel are weakly polarised (oxygen reduction occurs easily). In this environment, steel is normally protected by a passive film and passive film breakdown is principally induced by chloride contamination or carbonation of the concrete cover. Steel passivity is indicated by a positive open circuit (no applied current) potential. The open circuit potential is the result of the combination of the potential of an iron electrode with the potential of an oxygen electrode. Passive steel has an open circuit potential that tends towards the potential of the more positive oxygen electrode. When the passive film breaks down, the open circuit potential approaches the more negative iron electrode. An open circuit potential must not be confused with a driven potential. While a positive open circuit potential indicates the presence of an intact passive film on the steel, driving the steel potential to more positive values using an external source of power increases the force inducing iron to dissolve as positive iron ions and causes passive film breakdown and hence corrosion.

In the case of chloride induced corrosion, the local dissolution of iron at imperfections in the passive film is followed by reaction with water to produce iron oxide and hydrogen ions. The positive charge of the hydrogen ions is balanced by the negative charge of the chloride ions and the localised generation of hydrochloric acid occurs. This local reduction in pH destabilises the passive film and results in an accelerating and spreading corrosion process often called pitting corrosion. Chloride ions do not directly destabilise the iron oxides that make up the passive film. This is an indirect result of a local pH reduction.

Carbonation induced corrosion is also caused by a reduction in concrete pH that occurs as the result of the reaction of carbon dioxide and water with the alkalinity normally present in concrete. The generation of hydroxide at the steel is widely accepted as the protective effect that is relied on in the application of re-alkalisation to carbonated concrete. This is a less intensive treatment than chloride extraction and its application to arrest chloride induced corrosion would offer some practical advantages. A typical re-alkalisation treatment would require the application of 600 $kC/m^2$ (168 $Ah/m^2$) or 1 $A/m^2$ for one week (expressed per unit of steel surface area) to re-alkalise a substantial proportion of the carbonated concrete cover. This may be compared with the charge density of approximately 3600 $kC/m^2$ (1000 $Ah/m^2$) that is applied in a typical chloride extraction treatment.

Evidence that the generation of hydroxide at the steel is also the main protective effect of electrochemical treatments applied to chloride contaminated concrete primarily arises from the relatively low applied current densities and charge densities that induce open circuit steel passivity in chloride contaminated concrete.

In a laboratory study on intermittent cathodic protection applied to steel in heavily chloride contaminated specimens exposed to an aggressive simulated marine environment (Glass, Hassanein and Buenfeld, Corrosion Science, 43 (6) 1111-1131, 2001) an open circuit steel potential shift to more passive potential values was clearly evident after 6 months when the steel received integrated protection current densities of 6 and 40 $mA/m^2$ (expressed per unit of steel surface area). This positive potential shift indicates that the steel had gone passive. This conclusion was supported by photographs of the specimens obtained after 12 months of intermittent cathodic protection showing that continuing corrosion in the control specimens and specimens receiving a less intensive treatment had caused corrosion induced cracking while specimens exhibiting open circuit steel potentials typical of passive steel remained intact. Further analysis of this data indicates that, in the case of the specimen that received an integrated protection current density of just 6 $mA/m^2$, steel passivity was induced with a charge of less than 100 $kC/m^2$ (less than 28 $Ah/m^2$).

Strong evidence of the relatively small charge density required in practice to arrest chloride induced corrosion comes from an analysis of extensive data obtained in both field and laboratory cathodic protection studies. Cathodic protection design current densities will typically be up to 20 $mA/m^2$ and cathodic protection systems are usually commissioned at lower current densities. However it is common to achieve sizable potential shifts with such relatively small current densities after less than 50 days of cathodic protection. Sizable potential shifts at small applied current densities are only possible on passive or near passive steel (Glass, Roberts and Davison, Proc. 7th Int. Conf. Concrete in Hot and Aggressive Environments, October 2003, Volume 2, p. 477-492, 2003) and clear evidence of such induced passivity has been produced in laboratory conditions (Glass, Roberts and Davison, Corrosion 2004, NACE, Paper No. 04332, 2004). The charge equivalent to a protection current of 10 $mA/m^2$ applied for 50 days is less than 50 $kC/m^2$. This would be a more typical charge density required to induce steel passivity on a repaired concrete structure and is extremely small compared to the charge applied in a typical chloride extraction treatment (3600 $kC/m^2$).

The importance of the generation of hydroxyl ions at the steel is also supported by the observation that this induction of open circuit steel passivity is achieved using cathodic protection current densities that are substantially lower than the localised steel corrosion rates. Average corrosion rates of 0.02 mm steel section loss per year and localised corrosion rates greater than 0.1 mm per year are not uncommon in chloride contaminated concrete. These equate to corrosion current densities of approximately 20 and 100 $mA/m^2$. However cathodic protection design current densities are nearly always less than or equal to 20 $mA/m^2$ and applied current densities are invariably lower than the design current densities (BS EN 12696: 2000).

Two other factors further compound this surprising observation. Firstly, the applied protection current is not efficient in directly reducing the corrosion rate in atmospherically exposed concrete. The technical reason for this is that the cathodic reaction kinetics are weakly polarised (occur easily) in this environment. Secondly, the current preferentially flows to the more positive cathodes rather than the corroding anodes of the natural corrosion cells that are formed in concrete. It has been shown that, even in an arrangement where geometry and resistivity variations in the environment favour current distribution to the corroding steel, a modest applied current preferentially flows to the passive steel (Glass and Hassanein, Journal of Corrosion Science and Engineering, Volume 4, Paper 7, 2003).

In these conditions it is very unlikely that the applied current will result in the extraction of any chloride from the corroding anodic sites. To achieve a reversal in the direction of the local current at a corrosion site, sufficient current has to be applied to drive the potential to a value that would be more negative than the open circuit potential of an isolated corroding site not connected to any passive steel. At the modest applied protection current densities typically used in reinforced concrete cathodic protection, a net anodic current will always be leaving sites of high corrosion activity. However re-alkalisation of such sites is still possible because a pH concentration gradient between the surrounding concrete and the corroding sites will provide an additional force to move hydroxyl ions to the corroding sites. This combines with the electric field imposed by the cathodic protection system that weakens the strong electric fields that maintain the high hydroxyl ion concentration gradients to allow the pH to rise. As the pH rises, the process of establishing actively corroding sites on the steel is reversed until a point is reached where insoluble iron oxides are the most stable corrosion product and the steel passive film is re-formed. The process of re-alkalising the corroding sites to achieve open circuit steel passivity may be termed pit re-alkalisation.

The analysis above suggests that the range of charge densities applied to reinforcing steel in concrete to induce open circuit steel passivity may be an order of magnitude below that previously postulated to be necessary for stand alone temporary electrochemical treatments in U.S. Pat. No. 6,322,691. Less aggressive environments require less charge. Charge densities as low as 30 $kC/m^2$ may be sufficient on repaired concrete structures, a charge of 100 $kC/m^2$ has been shown to induce steel passivity in heavily chloride contaminated concrete in simulated marine exposure conditions in the laboratory and 600 $kC/m^2$ appears to be sufficient to re-alkalise not only the corroding sites (pit re-alkalisation), but a substantial proportion of the concrete cover in the re-alkalisation of carbonated concrete.

Improving the Electrochemical Treatment Process

A number of factors may be taken into account when considering methods of improving electrochemical treatment technologies for reinforced concrete. These include:

the speed with which the corrosion process is arrested,
the charge density required to arrest corrosion,
the durability of the treatment, and
the maintenance requirements of the process.

It has been noted above that relatively low charge densities may be used to restore steel passivity. A temporary electrochemical treatment process to arrest corrosion may therefore be substantially less intensive than the very intense temporary electrochemical treatments sometimes applied. In particular the period of a temporary electrochemical treatment may be reduced. Thus a temporary electrochemical treatment may be applied for less than 3 months and preferably less than 3 weeks. However, the durability of a short term treatment will be questioned despite the immediate reduction in corrosion rate. Such a brief initial treatment would be more acceptable if a supplementary long term corrosion prevention treatment was applied.

An improved treatment process would therefore be a hybrid electrochemical treatment in which an initial charge density that is sufficient to arrest corrosion and induce open circuit steel passivity was applied and followed by a low maintenance cathodic prevention treatment to prevent any subsequent corrosion initiation. It would be advantageous to use the same anode system in both the powerful impressed current treatment to arrest corrosion and in the subsequent low maintenance treatment to maintain steel passivity.

Two examples of such dual stage electrochemical treatments include:

- briefly driving a high current off a sacrificial anode to passivate the steel and then connecting the sacrificial anode directly to the steel to provide a low sacrificial current cathodic prevention treatment, and
- applying a voltage to an inert impressed current anode coated with a sacrificial metal element where the sacrificial metal element initially facilitates a high anodic reaction rate associated with a high protection current density to passivate the steel and when the sacrificial metal is consumed, the impressed current anode continues to provide a low impressed current cathodic prevention treatment.

The average current applied during the initial impressed current electrochemical treatment will typically be at least an order of magnitude greater than the average current subsequently applied during the low current preventative treatment. The low current preventative treatment will usually involve the delivery of an average current density of less than 5 $mA/m^2$ and more than 0.2 $mA/m^2$ to the steel surface.

Treatment Technology

The present invention provides, in a first aspect, a method of protecting steel in concrete that comprises using an anode and a source of DC power and a temporary impressed current treatment and a low current preventative treatment wherein the temporary impressed current treatment is a high current treatment using the source of DC power to drive current off the anode to the steel to improve the environment at the steel and the low current preventative treatment is applied to inhibit steel corrosion initiation after the application of the temporary impressed current treatment and the same anode is used in both treatments and the anode comprises a sacrificial metal element that undergoes sacrificial metal dissolution as its main anodic reaction.

In a second aspect the present invention provides an anode for protecting steel in concrete comprising a sacrificial metal element with an impressed current anode connection detail wherein the anode is a compact discrete anode and the sacrificial metal element is less noble than steel and the impressed current anode connection detail comprises a conductor with at least one connection point where the conductor remains passive at potentials more positive than +500 mV above the potential of the copper/saturated copper sulphate reference potential and the conductor is substantially surrounded by the sacrificial metal element over a portion of its length to form an electrical connection that conducts electrons between the conductor and the sacrificial metal and the connection point is on a portion of the conductor that extends away from the sacrificial metal element where the conductor may be conveniently connected to another conductor.

In a third aspect the present invention provides the use of the anode described in the second aspect of the present invention in the method described in the first aspect of the present invention.

In a fourth aspect the present invention provides the production of an activated sacrificial anode embedded in a chloride contaminated concrete structure that comprises providing a path for electrons to move between a conductor and a sacrificial metal element that is less noble than steel and forming a cavity in the concrete structure and embedding the sacrificial metal element in a porous material containing an electrolyte in the cavity leaving a portion of the conductor exposed to provide a connection point and providing a path for electrons to flow between a positive terminal of a source of DC power and the conductor and driving a high current off the sacrificial metal to draw chloride ions present in the concrete to the surface of the sacrificial metal to activate the sacrificial metal and disconnecting the source of DC power from the conductor.

In a fifth aspect the present invention provides a method of protecting steel in concrete that comprises a temporary high impressed current electrochemical treatment to improve the environment at the steel followed by a low current preventative treatment to inhibit steel corrosion initiation wherein an anode is used in the temporary impressed current treatment and the same anode is used in the low current preventative treatment and the anode comprises a sacrificial metal element that undergoes sacrificial metal dissolution as its main anodic reaction and the anode is connected to the positive terminal of a source of DC power in the temporary impressed current treatment and the anode is connected to the steel to provide a path for electron conduction from the sacrificial metal element to the steel in the low current preventative treatment.

One example of the preferred hybrid electrochemical treatment is illustrated in FIG. 1. A sacrificial metal element [1] is embedded in a porous material [2] containing an electrolyte in a cavity [3] formed in concrete [4]. The sacrificial metal element is connected to the positive terminal of a source of DC power [5] using an electrical conductor [6] and electrical connection [7]. An impressed current anode connection detail is used to connect the sacrificial metal element [1] to the electrical conductor [6]. This preferably involves forming the sacrificial metal element around a portion of a conductor [8] that remains passive during the impressed current treatment. The conductor [8] provides a convenient connection point [9] away from the sacrificial metal to facilitate a connection to another electrical conductor. The negative terminal of the power source [5] is connected to the steel [10] using an electrical conductor [11] and connection [12]. While the power supply is connected to the anode and the steel, electrical connection [13] is not made.

Initially a large, short term impressed current is driven from the anode assembly [1, 8] to the steel [10] for a brief period using the source of DC power [5]. In the process oxygen and water [14] are converted into hydroxyl ions [15] on the steel. This neutralises the acidic corrosion sites and promotes the repair of the protective passive film on the steel. In addition, aggressive ions such as chloride ions [16] are drawn from the concrete into the porous material [2] around the anode. The local environments around the embedded steel and around the embedded anode are modified by this brief impressed current treatment. The changes mean that the local environment at the steel supports steel passivation while the environment at the anode maintains sacrificial anode activity. The corroding sites are effectively moved from locations on the steel reinforcement to the installed sacrificial anode. At the end of the impressed current treatment, a long term low power cathodic prevention treatment may then be applied using the same anode.

It is preferable to disconnect the power supply [5] at electrical connections [7] and [12] and to connect remaining sacrificial anode metal directly to the steel through electrical connection [13]. The activated discrete sacrificial anode formed by the temporary impressed current treatment is then used in a long term sacrificial cathodic prevention role to maintain steel passivity. This is preferable because the current output of sacrificial anodes is more reliable than that of a DC power supply and is to some extent self adjusting with more aggressive environments leading to higher sacrificial anode current outputs. Furthermore, monitoring is not critical to sacrificial anode system function and can be tailored to compliment end user requirements for the protected structure. A simple method of monitoring performance uses non destructive potential mapping techniques to determine whether the only areas of anodic activity are located at the sites where the discrete sacrificial anodes are embedded.

The connections [7, 9, 12, 13] and conductors [6, 8, 11] are all electron conducting connections or conductors in that they provide a path for electrons to move. They may be referred to as electronic connections or electronic conductors. The conductors would typically be wires or electrical cables. These conductors and connections differ from ionic conductors or ionic connections. The electrolyte in the concrete [4] provides an example of an ionic connection between the sacrificial metal element [1] and the steel [10]. To achieve sacrificial cathodic protection or prevention, both an electronic connection and an ionic connection between the sacrificial metal element and the steel are required.

The sources of DC power [5] for the brief high current treatment include a mains powered DC power supply or a battery. It is an advantage if the connection between the anode and the positive terminal of the power supply is kept as short as possible to minimize the corrosion risk to this connection.

The preferred anode comprises a compact discrete sacrificial metal element with an impressed current anode connection detail. Compact discrete anodes may be embedded in cavities formed in reinforced concrete. This improves the bond between the anode and the concrete structure. Examples of such cavities include holes up to 50 mm in diameter and 200 mm in length that may be formed by coring or drilling as well as longer chases up to 30 mm in width and 50 mm in depth that may be cut into the concrete surface. When the cavities are holes formed by drilling, it is preferable to keep the diameter below 30 mm. A number of anodes will typically be distributed over the concrete structure to protect the embedded steel.

The impressed current anode connection detail is used to connect the anode to the positive terminal of the source of DC power. All metals connected to the positive terminal of a source of DC power are at risk of becoming anodes if they make contact with an electrolyte in the surrounding environment and therefore need to be protected from anodic dissolution if this is not intended. Existing compact discrete sacrificial anodes for reinforced concrete are supplied with connection details that consist of an uninsulated steel or galvanised steel wire which relies on the sacrificial operation of the anode to protect the connecting wire. These connections would suffer induced anodic dissolution and corrode along with the sacrificial metal when the anode is driven like an impressed current anode.

An impressed current connection detail in a compact discrete sacrificial anode may be achieved by forming the sacrificial metal element around a portion of a conductor that includes a second portion that provides a connection point and remains passive as the anode is driven to positive potentials by the power supply. A passive conductor is one on which no significant metal dissolution takes place and there is therefore no visible corrosion induced deterioration as its potential is driven to positive values. The conductor and sacrificial metal element will be driven to positive potentials during the initial impressed current treatment that are generally more noble (positive) than the copper/saturated copper sulphate reference electrode and may be more noble than +500 mV or even +2000 mV above the copper/saturated copper sulphate reference electrode. Copper and steel do not remain naturally passive at these positive potentials when they are in contact with an electrolyte.

The example in FIG. 1 shows a sacrificial metal element [1] that is formed around a portion of a conductor [8] with a second portion extending beyond the sacrificial metal providing a connection point [9]. To achieve a passive conductor, an inert conductor that is naturally passive in contact with an electrolyte at the anode potentials arising in impressed current treatment may be used. Alternatively the conductor may be isolated from electrolyte in the environment by the presence of the surrounding sacrificial metal element and the presence of a layer of insulation on the portion of the conductor that extends beyond the sacrificial metal element to form the connection point. The preferred connection detail involves casting the sacrificial metal element around a portion of an inert titanium wire that provides a connection point on an exposed portion of titanium wire away from the sacrificial metal element to conveniently connect the titanium wire to another electronic conductor. This may be another titanium wire or an insulated electrical cable that facilitates the connection of the anode to the positive terminal of the source of DC power.

An inert conductor may derive its corrosion resistance from one or more materials, examples of which include carbon, titanium, stainless steels including nickel-chrome-molybdenum stainless steel alloys, platinum, tantalum, zirconium, niobium, nickel, nickel alloys including hastalloy, monel and inconel. The conductors may be made from these materials or protected with inert coatings of these materials. Titanium is a preferred material because it is readily available and it resists anodic dissolution over a wide range of potentials.

The use of an inert impressed current anode as the conductor around which the sacrificial metal element is formed allows the anode to be used as an inert impressed current anode in an impressed current cathodic prevention role when the sacrificial metal element around the inert anode is consumed. This extends the functional life of the anode system. Examples of inert impressed current anodes include metal oxide coated titanium, platinised titanium and platinised niobium. The inert anode conductor will, in theory, be surrounded by a porous metal oxide or salt arising from the dissolution of the sacrificial metal. This provides a layer that sustains a pH gradient between the inert anode and the surrounding concrete that limits acid attack of the surrounding concrete. It also provides a route by which any gas generated at the anode may escape. These features will allow an inert anode core to be driven at current densities above the limits normally imposed on the use of such anodes when they make direct contact with cement mortar or concrete.

A conductor such as steel may be rendered passive using an insulating material to separate the conductor from the electrolyte in the surrounding environment. This prevents corrosion induced deterioration of the portion of the conductor that is not shielded by the sacrificial metal when the anode is used in its impressed current role. In this case it is preferable to extend the insulation either into the anode metal or over the surface of the anode metal where the conductor enters the anode metal. This is to maintain the separation of the conductor from the electrolyte in the surrounding environment as the sacrificial anode metal dissolves around the conductor. It is preferable to insulate all cable connections between the anode and the positive terminal of the source of DC power from the electrolyte in the surrounding environment.

The sacrificial metal is preferably less noble than steel. Examples include zinc, aluminium or magnesium or alloys thereof. An aluminium zinc indium alloy is preferred. Aluminium has a high charge density and therefore a favourable life to volume ratio. The alloying elements promote anode activity that is further promoted by the presence of chloride contamination in the surrounding environment.

The principal anodic reaction occurring on a sacrificial metal anode is the dissolution of the sacrificial metal. This oxidation reaction occurs much more easily than the oxidation of water to produce acid and gas which is the main anodic reaction that occurs on an inert impressed current anode. Large anode current densities may therefore be delivered at low driving voltages from sacrificial metal elements. The dissolution of the sacrificial metal produces a metal salt. The production of gas may be avoided and the only acid that is produced is the result of the secondary hydrolysis reaction of the metal salt. This secondary reaction will be limited. The minimum pH value is determined by the equilibrium between the metal salt, the acid present (which determines the pH) and the metal oxide. The problems associated with the production of acid and gas that commonly occur on inert impressed current anodes, may be avoided by the use of a sacrificial metal element in the anode. In this way current densities greater than 200 $mA/m^2$ and preferably greater than 1000 $mA/m^2$ expressed per unit area of anode surface may be achieved on an embedded anode without significant deterioration of the surrounding concrete occurring.

The preferred placement of sacrificial anode materials in the past has been on concrete surfaces where they are accessible and easily replaced. However loss of adhesion to the concrete substrate and rapid drying of the concrete surface in the absence of moisture limits the performance off anodes on the surface. These problems may be overcome by embedding the sacrificial metal anodes in a porous material in cavities in concrete. The porous material holds the anode in place while its porosity also holds the electrolyte and provides space for the products of anode dissolution. To accommodate the products of anodic dissolution it is preferable that the porous material has 'putty like' properties, including a compressive strength of less than 1 N/mm$^2$ and preferably less than 0.5 N/mm$^2$ and contains compressible void space.

One feature of the use of a sacrificial metal in an impressed current role is the ease with which any accidental anode-steel shorts (contact between the anode and the steel that provide a path for electrons to flow directly from the anode to the steel) may be overcome. This is because the sacrificial metal preferentially corrodes at the location of the dissimilar metal short to generate a metal oxide that breaks the direct short.

One advantage of using an embedded sacrificial metal anode is the high impressed current density that may be delivered of the anode. The magnitude of the current was assessed by determining the anodic polarisation behaviour (anode current output as a function of anode potential) of an aluminium alloy anode embedded in plaster in a hole in concrete, and comparing this polarisation behaviour with that determined on a mixed metal oxide (MMO) coated titanium inert anode in the same environment.

An aluminium alloy was cast around a MMO coated titanium wire to produce a sacrificial anode with an exposed aluminium surface of 2180 mm$^2$ connected to a length of exposed titanium wire. The aluminium alloy was US Navy specification MIL-A-24779(SH). A 1.0 mm$^2$ copper core sheathed cable was connected to the exposed titanium wire. The copper-titanium connection was maintained in a dry environment above the concrete.

An inert anode was produced using a short length of MMO coated titanium ribbon connected to a 1.0 mm$^2$ copper core sheathed cable. The connection was insulated and the exposed MMO coated titanium surface measured 1390 mm$^2$.

Figure 2:
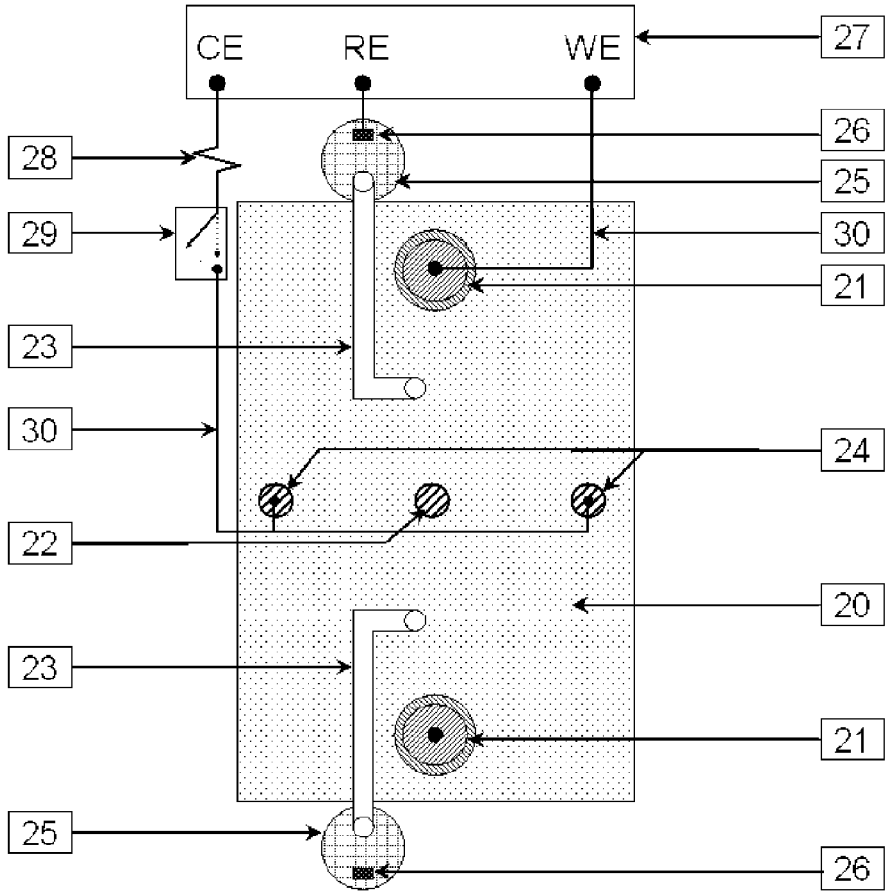
FIG. 2 shows the experimental arrangement used to determine an anode potential-current relationship.

The polarisation behaviour (potential-current relationship) of the aluminium and MMO coated titanium anodes were determined using the experimental arrangement shown in FIG. 2. A concrete block [20] measuring 300 mm long by 140 mm wide and 120 mm deep was cast using dry 20 mm all-in graded aggregate (0 to 20 mm), ordinary Portland cement (OPC) and water in the proportions of 8:2:0.95 by weight respectively. Sodium chloride was dissolved in the water prior to mixing the concrete to contaminate the concrete block with 3% chloride (expressed as weight percent of chloride ions to cement).

While the concrete was still fluid, two holes [21] 22 mm diameter and 90 mm deep were formed 200 mm apart in the concrete block by pressing a rigid plastic tube into the concrete. A steel bar [22] with a diameter of 10.5 mm and length of 140 mm was located in the concrete midway between the two holes. It extended 40 mm above the concrete surface. The ends of two flexible Luggin capillary tubes [23] with an internal diameter of 2 mm were located in the concrete midway between each hole and the steel bar. Two additional steel bars [24] were embedded 100 mm apart and equidistant from the holes [21] to be used as counter electrodes in the test. Sheathed copper core cables were connected to the exposed ends of the steel bars.

After the concrete had hardened, the rigid plastic tubes were removed, the aluminium anode and the MMO coated titanium anode were centrally located in separate holes [21] and the remaining space in the holes was filled with a gypsum based finishing plaster to leave an indentation in the surface above the anode. The plaster was left to harden to form a rigid porous material. The Luggin capillary tubes [23] were filled with a conductive gel made by heating whilst stirring, a mixture of agar powder, potassium chloride and water in the proportions of 2:2:100 by weight respectively. The gel filled Luggin capillary tubes extended to small containers [25] containing a saturated copper sulphate solution. A piece of bright abraded copper [26] was placed in each container to form two copper/saturated copper sulphate reference electrodes. A copper core cable was connected to the copper of the reference electrode with and the connection was insulated.

A potentiostat and function generator [27] were used to control and vary the potential of the anode relative to the potential of the reference electrode by passing current from the counter electrodes to the anode under test. A separate test was undertaken for each anode. An anode and its nearest copper/saturated copper sulphate reference electrode were connected to the working electrode (WE) and reference electrode (RE) terminals respectively of the potentiostat/function generator [27]. A 5 Ohm resistor [28] and a relay switch [29] were connected between the counter electrodes and the counter electrode terminal (CE) of the potentiostat/function generator. Sheathed copper core cables [30] were used in all the connections. The testing took place indoors at a temperature between 7 and 15° C. The indents in the plaster above the anodes were periodically wetted.

The measurements included the anode current, the current-on potential of the anode measured relative to the reference electrode while the current was flowing and the instant-off potential of the anode measured between 0.02 and 0.07 seconds after momentarily interrupting the current from the anode for a period of not more than 0.15 seconds using the relay switch [29]. The instant-off potential of the anode is a corrected potential in which the geometry dependent voltage drop between the anode and the reference electrode induced by the current is subtracted from the current-on anode potential. These measurements were recorded using a high impedance data logger that also controlled the relay switch. The potential of the anode was initially controlled at a value close to its natural potential in the absence of any current. The controlled potential was then increased at a rate of 0.1 mV/s to approximately +2000 mV relative to the reference electrode to obtain the polarisation behaviour.

Figure 3:
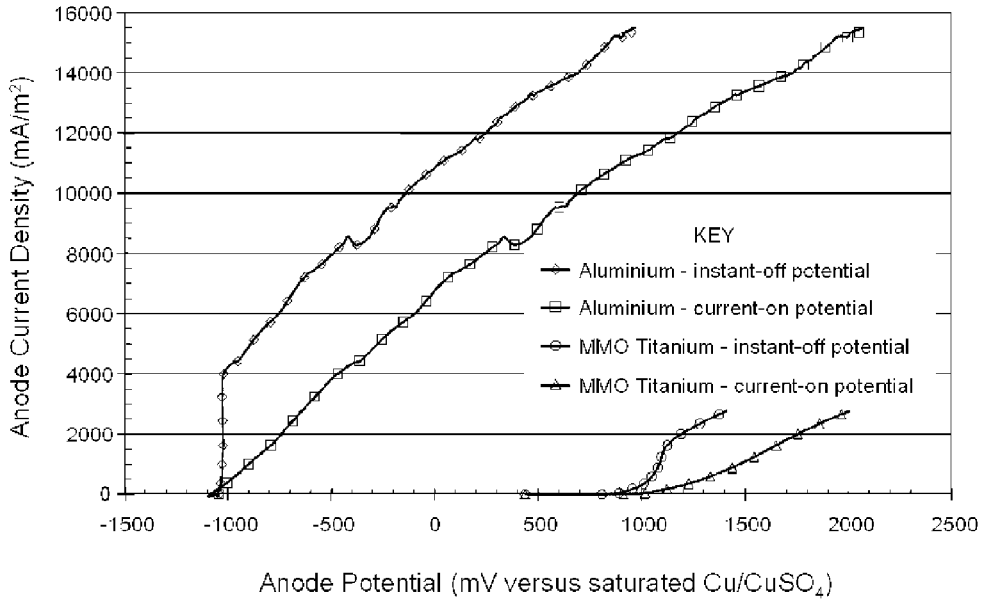
FIG. 3 shows the potential-current relationship determined on an aluminium alloy anode and a mixed metal oxide (MMO) coated titanium anode.

FIG. 3 shows the aluminium anode and MMO coated titanium anode current density outputs as a function of their current-on potentials and instant-off potentials measured relative to the reference electrode 10 days after casting the concrete. The current density on the y-axis is expressed as current per unit area of anode surface and is plotted against the potential in mV relative to the copper/saturated copper sulphate reference electrode on the x-axis. As the current-on potential of the aluminium anode increased to +2000 mV, the current density off the aluminium increased to 16000 mA/m$^2$ and the instant-off potential of the aluminium increased to +1000 mV. By contrast the current off the MMO coated titanium anode was only significant as its potential was increased above +1000 mV. At a current-on potential of +2000 mV the MMO coated titanium anode current density approached 3000 mA/m$^2$ and its instant-off potential was +1400 mV. The aluminium was therefore capable of generating much higher current densities at lower anode potentials. Indeed the current density delivered by the aluminium anode was greater than 10000 mA/m$^2$ when its instant-off potential reached the potential of the copper/saturated copper sulphate reference electrode.

The comparison of the anodic polarisation characteristics of an aluminium anode with those of a MMO coated titanium anode in this example shows the significant advantages to be gained by using embedded sacrificial metals in an impressed current role. The use of a sacrificial metal embedded in a porous material in a hole in reinforced concrete allows anode impressed current densities to be achieved that are substantially greater than any of those achieved using existing impressed current anode technology at the same driving voltage.

One issue concerning the use of a sacrificial metal anode embedded in a porous material applied to reinforced concrete is the life of the anode. The life of the hybrid anode is related to its size and current output. A typical size for a long life is calculated using the following assumptions:

- A current of 500 mA/m$^2$ applied to the steel for 1 week will change the local environment at the steel to induce steel passivation.
- An average protection current of 1 mA/m$^2$ will maintain steel passivity and prevent corrosion initiation for the next 50 years.
- The installation of 4 anodes per square meter will achieve a reasonable current distribution.
- A discrete aluminium alloy anode is used with a density of 2700 kg/m$^3$, a charge density of 2980 Ah/kg and an efficiency of 93%.

A current of 500 mA for 7 days followed by 1 mA for 50 years is equivalent to a charge of 522 Ah, or 130 Ah per anode. The sacrificial metal properties indicate a useful charge of 7458 Ah per liter of anode metal and a 130 Ah anode can be achieved with an anode volume of 0.0174 liters. This may be achieved by an anode that is 15 mm in diameter and 100 mm in length. The installation of four anodes of this size for every square meter of steel surface in a concrete structure is a relatively easy task.

As noted above 500 mA/m$^2$ applied to the steel for one week will be more than sufficient to induce changes in the environment leading to steel passivity in most cases. A cathodic prevention current density of 1 mA/m$^2$ is the middle of the expected range of cathodic prevention current densities disclosed in BS EN 12696:2000. This calculation shows that it is practical to use embedded sacrificial anodes in a hybrid electrochemical treatment and to achieve a long service life.

The invention will now be further described in the following examples.

Example 1

An anode 15 mm in diameter and 100 mm long comprising a bar of the aluminium alloy known as US Navy specification MIL-A-24779(SH) that was cast around a titanium wire to facilitate the electrical connection to the aluminium was embedded in a lime putty in a 25 mm diameter by 130 mm deep hole in a concrete block. The basic arrangement is shown in FIG. 1. The concrete block measuring 380 by 270 by 220 mm was made using graded all-in-one 20 mm aggregate and ordinary Portland cement in the ratio 8:1. The water to cement ratio was 0.6 and 4% chloride ion by weight of cement was added to the mix by dissolving sodium chloride in the mix water. A sheet of steel with a surface area of 0.125 m$^2$ was included in the concrete block. The lime putty was produced by slaking and maturing quicklime and was sourced from a manufacturer of lime putty and lime mortars. The hole in the concrete block containing the lime putty and the anode was left open to the air. The concrete block was stored in a dry indoor environment and the temperature varied between 10 and 20 C.

Figure 4:
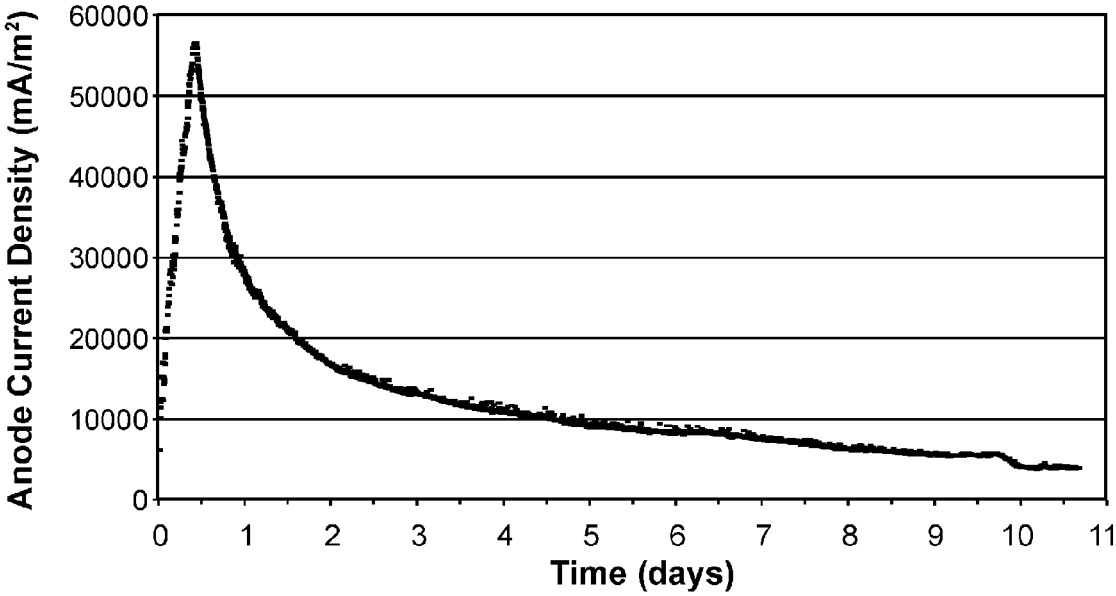
FIG. 4 shows the current density driven off an aluminium alloy anode in an aggressive environment using a DC power supply in example 1.

The anode and the steel were connected to a 12 Volt DC power supply for a period of 13 days during which a charge of 65 kC was delivered from the anode to the steel. The current density delivered off the anode for the first 11 days is given in FIG. 4. For most of this time, the current delivered off the anode was greater than 5000 mA/m$^2$.

Figure 5:
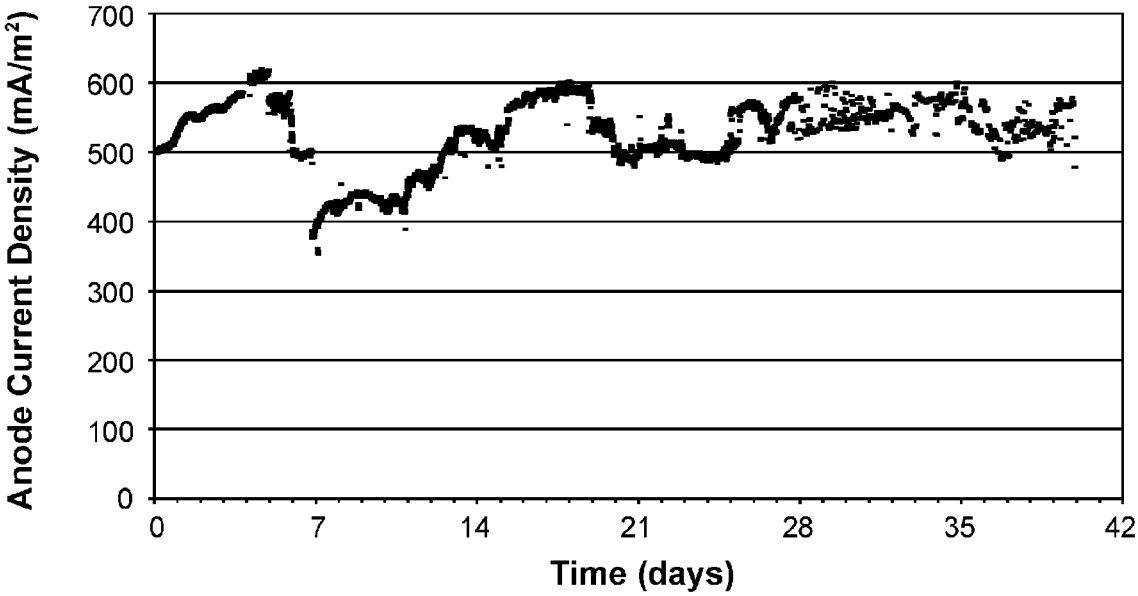
FIG. 5 shows the galvanic current density delivered off an aluminium alloy anode following an initial impressed current treatment in example 1.

At the end of the period of impressed current treatment, the DC supply was removed and the anode was connected to the steel. The galvanic current off the anode was measured using a 1 ohm resistor as a current sensor in the connection between the anode and the steel. The current density delivered off the anode acting purely in a galvanic mode for the next 40 days is given in FIG. 5. For most of this period, the current density delivered off the anode was between 500 and 600 mA/m$^2$.

It may be noted that the presence of 4% chloride in the concrete represents a very aggressive environment leading to a very high current output of the sacrificial anode when operating in both impressed current and galvanic modes.

Example 2

Twenty five aluminium alloy anodes 15 mm in diameter and 100 mm long described in example 1 were embedded in a concrete column containing steel reinforcement with a steel surface area of 3.2 m$^2$. The column was sheltered from rain and moisture and was very dry, but was within sight of the sea and exposed to airborne chloride contamination. The anodes were installed by drilling 25 mm holes 180 mm into the concrete, partially filling the holes with a mixture of lime putty and 10% polystyrene and finally pressing the anodes into the putty until they were fully embedded in the putty. The anodes were evenly distributed over the column and were located between the reinforcing steel bars.

Figure 6:
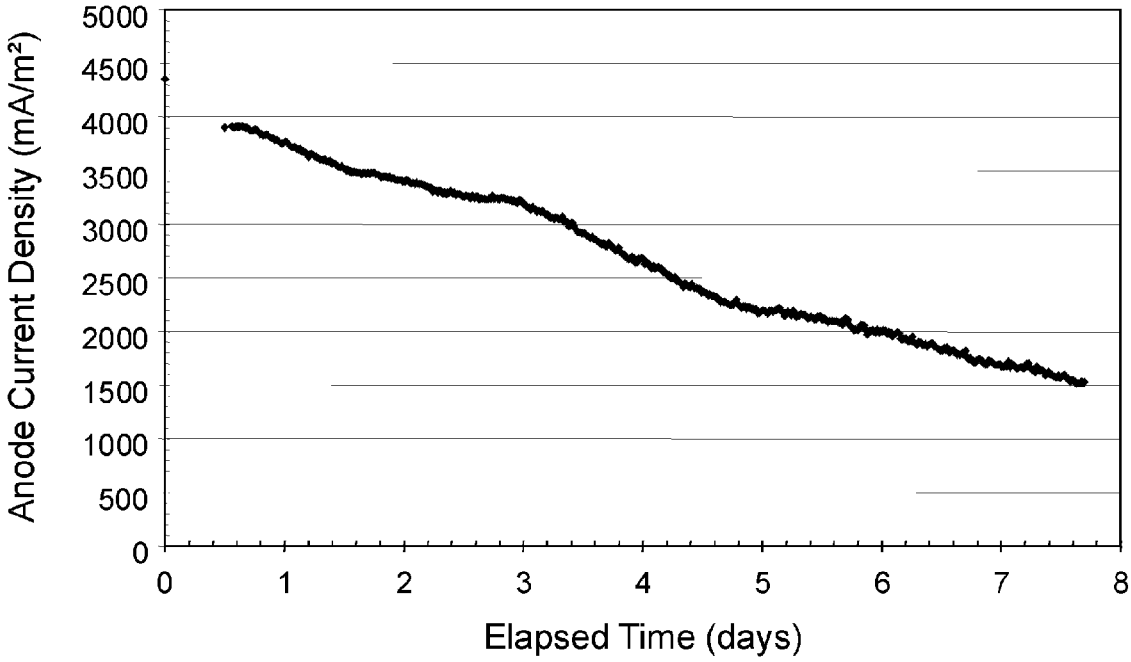
FIG. 6 shows the current density driven off 25 aluminium alloy anodes in a mild environment using a DC power supply in example 2.

The anodes were connected to the positive terminal of a 12 Volt DC power supply and the steel was connected to the negative terminal for a period of 8 days during which time a charge of 67 kC/m$^2$ was delivered to the steel surface. The current density delivered off the anodes during this period is given in FIG. 6. The current delivered off the anodes varied between 4500 and 1500 mA/m$^2$. After this initial treatment the holes containing the anodes were sealed with a standard cement mortar repair material.

Figure 7:
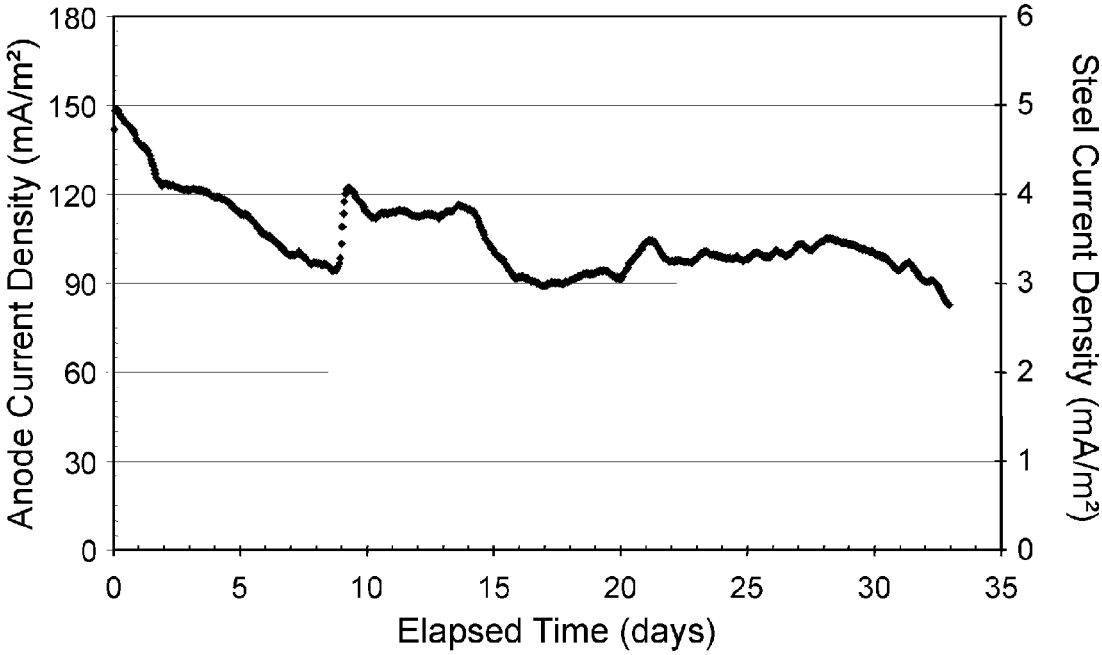
FIG. 7 shows the galvanic current density delivered off 25 aluminium alloy anodes following an initial impressed current treatment in example 2.

At the end of the period of impressed current treatment, the DC supply was removed and the anodes were connected to the steel. The galvanic current off the anodes was measured using a 1 ohm resistor as a current sensor in the connection between the anodes and the steel. The current density delivered off the anodes acting purely in a galvanic mode for the next 30 days is given in FIG. 7. The galvanic current density delivered off the anodes was between 80 and 150 mA/m$^2$ which equates to a protection current on the steel surface of between 3 and 5 mA/m$^2$.

The very dry conditions represent a relatively non-aggressive environment and both the impressed anode current density and the galvanic anode current density were low compared to the data obtained in example 2. However the galvanic current delivered to the steel as a preventative treatment is relatively high for cathodic prevention, particularly in this environment. The remaining life of the sacrificial metal in the anodes delivering 3 mA/m$^2$ to the steel, assuming an anode efficiency of 70%, was calculated to be 28 years and will be longer if the average applied cathodic prevention current density stabilises at a lower value.

INDUSTRIAL APPLICABILITY

The industrial use of the disclosed technology relates to methods and products for arresting and preventing the corrosion of steel in reinforced concrete structures. Advantages of the disclosed technology include rapid inhibition of steel corrosion, brief on site treatment time, no regular long term maintenance, easy installation and self correction of accidental anode to steel shorts. Standards applicable to this technology include BS EN 12696: 2000 (Cathodic protection of steel in concrete) and prCEN/TS 14038-1 (Electrochemical realkalisation and chloride extraction treatments for reinforced concrete).

The invention claimed is:

1. A method of protecting steel in a concrete construction using at least one anode assembly and a DC power source, the method comprising the steps of:

driving a current off the anode assembly to the steel to be protected, during a one protection step, using the DC power source in order to minimize steel corrosion;

delivering a preventative current from the anode assembly to the steel to be protected, during a subsequent protection step, in which the preventative current substantially inhibits initiation of further steel corrosion with the current of the one protection step being greater than the current of the subsequent protection step; and providing the anode assembly with an inert anode being at least partially coated with a sacrificial metal element that undergoes sacrificial metal dissolution as a main anodic reaction of the sacrificial metal element and supplies the current during the one protection step.

2. The method according to claim 1, further comprising the steps of consuming the sacrificial metal element of the anode assembly, during the one protection step, so as to expose the inert anode; and achieving the subsequent protection step from the exposed inert anode.

3. The method according to claim 1, further comprising the step of forming the anode assembly as a compact discrete anode assembly embedded within a cavity formed in a concrete construction.

4. The method according to claim 1, further comprising the step of using an anode current density greater than 1000 mA per square meter of anode surface area during the one protection step.

5. The method according to claim 1, further comprising the step of rendering the steel substantially passive.

6. A method of minimizing corrosion of steel in a chloride contaminated concrete structure and maintaining steel passivity with an activated sacrificial anode assembly, the method comprising the steps of:

forming a flow path for electrons to travel between a conductor and a sacrificial metal element which is less noble than steel;

forming a cavity within the concrete structure;

embedding the sacrificial metal element within the cavity in a porous material containing an electrolyte;

leaving a portion of the conductor exposed so as to provide a connection point to the conductor;

providing a flow path for electrons to travel between the conductor and a positive terminal of a DC power source;

driving a high current off the sacrificial metal element to draw chloride ions, present in the concrete structure, to the surface of the sacrificial metal element to activate the sacrificial metal element and thereby minimize corrosion of the steel; and disconnecting the DC power source from the conductor.

7. The method according to claim 6, further comprising the steps of impressing the current off the sacrificial metal element at greater than 200 mA per square meter of anode surface.

8. The method according to claim 7, further comprising the step of delivering the current impressed off the sacrificial metal element at a current greater than 1000 mA per square meter of anode surface.

9. The method according to claim 6, further comprising the step of forming the sacrificial metal element around a portion of the conductor.

10. The method according to claim 6, further comprising the steps:

permitting the conductor to remain passive when the conductor contacts the electrolyte in the concrete structure; and driving a potential of the conductor structure to a value greater than +500 mV above a copper/saturated copper sulphate reference potential.

11. The method according to claim 10, further comprising the step of forming the conductor from titanium.

12. The method according to claim 6, further comprising the step of rendering the steel substantially passive.

13. The method according to claim 6, wherein minimizing corrosion of the steel further comprises at least one of the following steps:

driving current to the steel after formation of the anode, and connecting the anode to the steel after activation of anode.

14. A method of protecting steel in concrete that uses at least one anode assembly in a temporary impressed current electrochemical treatment in order to minimize corrosion of the steel to be protected, the method comprising the steps of:

performing the temporary impressed current electrochemical treatment for a period of time that is substantially shorter than a period of time of a protective effect induced by the temporary impressed current electrochemical treatment;

using a sacrificial anode assembly, comprising a sacrificial metal element which is less noble than steel, which undergoes sacrificial metal dissolution as a main anodic reaction, as part of the anode assembly;

connecting the sacrificial anode assembly to a positive terminal of a DC power source in the temporary impressed current treatment; and connecting the steel to be protected to a negative terminal of the DC power source in the temporary impressed current treatment.

15. The method according to claim 14, further comprising the step of creating a galvanic current by forming a path for electron conduction from the sacrificial metal element to the steel to be protected, during a subsequent protection step, following completion of the temporary impressed current electrochemical treatment.

16. The method according to claim 15, further comprising the step of embedding the anode assembly in a cavity comprising one of a cored hole, a drilled hole and a cut chase.

17. The method according to claim 15, further comprising the step of providing an impressed current connection which remains passive at a potential greater than +500 mV above a potential of the copper/saturated copper sulphate reference potential as part of the anode assembly.

18. The method according to claim 15, further comprising the step of delivering the temporary impressed current treatment at an anode current density greater than 200 mA per square meter of anode surface.

19. The method according to claim 15, further comprising the step of delivering the temporary impressed current treatment at an anode current density greater than 1000 mA per square meter of anode surface.

20. The method according to claim 15, further comprising the step of delivering the temporary impressed current treatment at an average current that is at least an order of magnitude greater than an average current of the subsequent protection step.

21. The method according to claim 15, further comprising the step of delivering the temporary impressed current treatment for a duration of time of about 3 months or less.

22. The method according to claim 21, further comprising the step of delivering the temporary impressed current treatment for a duration of time of about 3 weeks or less.

23. The method according to claim 15, further comprising the step delivering an average current to the steel to be protected at a current of less than 5 mA per square meter of steel during the subsequent protection step.

24. The method according to claim 15, further comprising the step of delivering the subsequent protection step for a duration of time that is substantially equal to the duration of time of a protective effect provided by the subsequent protection step.

25. The method according to claim 14, further comprising the steps of:

forming a cavity comprising one of a cored hole, a drilled hole and a cut chase; and embedding the anode assembly, as a compact discrete anode assembly, in a porous material located within the cavity.

26. The method according to claim 14, further comprising the step of using one of aluminum, zinc, magnesium and an alloy thereof as the sacrificial metal element.

27. The method according to claim 14, further comprising the step of delivering the charge density to the steel in the temporary impressed current treatment at a density of less than 100 kC per square meter of steel.

28. The method according to claim 14, further comprising the step of rendering the steel substantially passive.

29. An anode assembly for arresting corrosion of steel in concrete and subsequently maintaining steel passivity, the anode assembly comprising:

a sacrificial metal element with an impressed current anode connection;

the anode assembly being a discrete anode assembly for insertion into a cavity comprising one of a cored hole, a drilled hole and a cut chase;

the sacrificial metal element being less noble than steel;

the impressed current anode connection comprising a conductor that remains passive at a potential greater than +500 mV above a potential of a copper/saturated copper sulphate reference potential;

the conductor being connected to the sacrificial metal element to form an electrical connection that conducts electrons between the conductor and the sacrificial metal element; and the conductor extending away from the sacrificial metal element to provide a connection point for connecting the conductor to at least one additional conductor.

30. The anode assembly according to claim 29, wherein the conductor is substantially surrounded by the sacrificial metal element over a portion of length of the connector.

31. The anode assembly according to claim 29, wherein the anode assembly is sized to fit within the cavity which is about 50 mm or less in diameter and about 200 mm or less in length, and the cavity is one of cored and drilled into the concrete.

32. The anode assembly according to claim 29, wherein the cavity is a cut chase in the concrete and the anode assembly is sized to fit within the cut chase which is about 30 mm or less in width and about 50 mm or less in depth.

33. The anode assembly according to claim 29, wherein the conductor remains passive at a potential greater than +2000 mV above the potential of the copper/saturated copper sulphate reference potential.

34. The anode assembly according to claim 29, wherein the conductor comprises a wire.

35. The anode assembly according to claim 29, wherein the conductor is inerted and remains passive when exposed to an electrolyte.

36. The anode assembly according to claim 35, wherein the corrosion resistance of the conductor is derived from at least one material selected from the group consisting of carbon, titanium, stainless steel, nickel-chrome-molybdenum stainless steel alloy, platinum, tantalum, zirconium, niobium, nickel, nickel alloys, hastalloy, monel and inconel.

37. The anode assembly according to claim 35, wherein the conductor is titanium.

38. The anode assembly according to claim 35, wherein the conductor comprises an inert impressed current anode.

39. The anode assembly according to claim 38, wherein the inert impressed current anode is selected from the group consisting of metal oxide coated titanium, platinised titanium, and platinised niobium.

40. The anode assembly according to claim 29, wherein a layer of insulation material isolates the conductor.

41. The anode assembly according to claim 40, wherein the insulation material extends into a body of the sacrificial metal.

42. The anode assembly according to claim 40, wherein the layer of insulation material extends over a portion of the sacrificial metal surface where the conductor extends to the sacrificial metal.

43. The anode assembly according to claim 29, wherein the anode assembly further comprises a porous embedding material for embedding the anode assembly within a cavity formed in the concrete.

44. The anode assembly according to claim 43, wherein the porous embedding material has a compressive strength about 1 $N/mm^2$ or less.

* * * * *